United States Patent [19]

Terauchi et al.

[11] Patent Number: 4,490,099

[45] Date of Patent: Dec. 25, 1984

[54] SCROLL TYPE FLUID DISPLACEMENT APPARATUS WITH THICKENED CENTER WRAP PORTIONS

[75] Inventors: Kiyoshi Terauchi, Isesaki; Masaharu Hiraga, Honjyo, both of Japan

[73] Assignee: Sanden Corporation, Japan

[21] Appl. No.: 595,645

[22] Filed: Apr. 3, 1984

Related U.S. Application Data

[63] Continuation of Ser. No. 308,165, Oct. 2, 1981, abandoned.

[30] Foreign Application Priority Data

Oct. 3, 1980 [JP] Japan ..... 55-138289
Jul. 16, 1981 [JP] Japan ..... 56-111366

[51] Int. Cl.[3] ..... F01C 1/02
[52] U.S. Cl. ..... 418/55; 418/83
[58] Field of Search ..... 418/55, 57, 59, 83

[56] References Cited

U.S. PATENT DOCUMENTS 2,324,168 7/1943 Montelius ..... 418/55
3,473,728 10/1969 Vulliez ..... 418/55
3,802,809 4/1974 Vulliez ..... 418/55
3,874,827 4/1975 Young ..... 418/55
4,304,535 12/1981 Terauchi ..... 418/55
4,382,754 5/1983 Shaffer et al. ..... 418/55

*Primary Examiner*—John J. Vrablik
*Attorney, Agent, or Firm*—Banner, Birch, McKie & Beckett

[57] ABSTRACT

A scroll type fluid displacement apparatus including a housing, a pair of scroll members each comprising an end plate and a spiral wrap means projecting from one surface of the end plate. Both wrap means are interfitted to make a plurality of line contacts between them, and a driving mechanism including a drive shaft is connected to one of the scroll members to effect orbital motion thereof relative to the other (fixed) scroll member while rotation of the orbiting scroll is prevented. The center portions of the wrap means are made thicker than the remaining portions thereof, the center portions extending substantially from the inner ends of the wrap means outwardly at least throughout the portions thereof which contact one another when the two innermost fluid pockets are merged into a single fluid pocket to form the high pressure space near the center of the scroll members. This construction insures sealing of the high pressure space from adjacent fluid pockets, keeping volumetric efficiency and horsepower requirement of the unit to a certain level under a limited accuracy of machining of the spiral elements.

15 Claims, 16 Drawing Figures

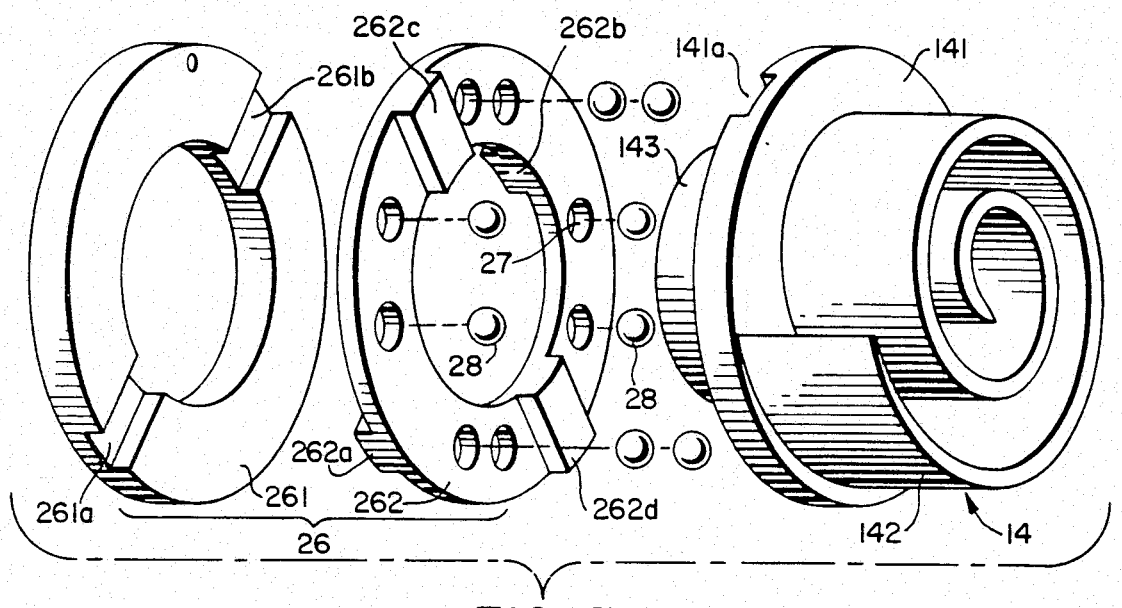
FIG. 7
FIG. 8
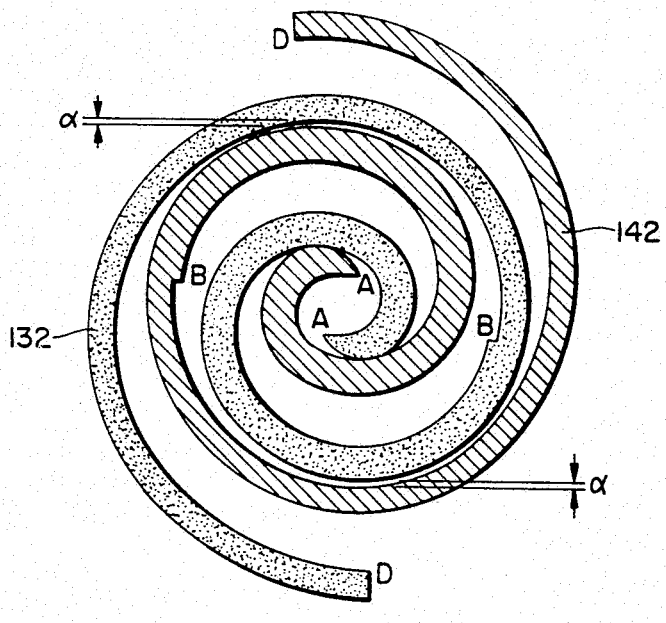

SCROLL TYPE FLUID DISPLACEMENT APPARATUS WITH THICKENED CENTER WRAP PORTIONS

This application is a continuation of application Ser. No. 308,165, filed Oct. 2, 1981, now abandoned.

BACKGROUND OF THE INVENTION

This invention relates to a fluid displacement apparatus of the scroll type, such as a compressor, expander, or pump.

Scroll type fluid displacement apparatus are well known in the prior art. For example, U.S. Pat. No. 801,182 discloses a scroll type fluid displacement apparatus including two scroll members, each having a circular end plate and a spiroidal or involute spiral element. These scroll members are maintained angularly and radially offset so that both spiral elements interfit to make a plurality of line contacts between spiral curved surfaces to thereby seal off and define at least one pair of fluid pockets. The relative orbital motion of the two scroll members shifts the line contacts along the spiral curved surfaces and, therefore, the fluid pockets change in volume. The volume of the fluid pockets increases or decreases depending on the direction of the orbiting motion. Therefore, the scroll type fluid displacement apparatus is applicable to compress, expand or pump fluids. For the sake of convenience, the discussion which follows deals only with scroll type devices used as compressors.

In comparison with a conventional compressor of the piston type, the scroll type compressor has certain advantages, such as fewer parts and continuous compression of fluid. However, there have been several problems, primarily in the sealing of the fluid pockets. Sealing of the fluid pockets must be sufficiently maintained at axial and radial interfaces in the scroll type compressor, because the fluid pockets are defined by the line contacts between the interfitting spiral elements and axial contact between the axial end surfaces of the spiral elements and the inner end surfaces of the end plates.

The principles of operation of a typical scroll type compressor will be described with reference to FIGS. 1*a*–1*d*, FIG. 2 and FIG. 3. FIGS. 1*a*–1*d* schematically illustrate the relative movement of interfitting spiral elements to compress the fluid. FIG. 2 diagrammatically illustrates the compression cycle in each of the fluid pockets. FIG. 3 schematically illustrates the typical interfitting relationship of prior art spiral elements.

FIGS. 1*a*–1*d* may be considered to be end views of a compressor wherein the end plates are removed and only the spiral elements are shown. Two spiral elements 1 and 2 are angularly offset and interfit with one another. As shown in FIG. 1*a*, the orbiting spiral element 1 and fixed spiral element 2 make four line contacts as shown at four points A–D. A pair of fluid pockets 3*a* and 3*b* are defined between line contacts D-C and line contacts A-B, as shown by the dotted regions. The fluid pockets 3*a* and 3*b* are defined not only by the wall of spiral elements 1 and 2 but also by the end plates from which these spiral elements extend. When orbiting spiral element 1 is moved in relation to fixed spiral element 2 so that the center 0′ of orbiting spiral element 1 revolves around the center 0 of fixed spiral element 2 with a radius of 0—0′, while the rotation of orbiting spiral element 1 is prevented, the pair of fluid pockets 3*a* and 3*b* shift angularly and radially towards the center of the interfitted spiral elements with the volume of each fluid pocket 3*a* and 3*b* being gradually reduced, as shown in FIGS. 1*a*–1*d*. Therefore, the fluid in each pocket is compressed.

Now, the pair of fluid pockets 3*a* and 3*b* are connected to one another while passing the stage from FIG. 1*c* to FIG. 1*d* and as shown in FIG. 1*a*, both pockets 3*a* and 3*b* merge at the center portion 5 and are completely connected to one another to form a single pocket. The volume of the connected single pocket is further reduced by further revolution of 90° as shown in FIGS. 1*b*, 1*c* and 1*d*. During the course of rotation, outer spaces which open in the state shown in FIG. 1*b* change as shown in FIGS. 1*c*, 1*d* and 1*a*, to form new sealed off pockets in which fluid is newly enclosed.

Accordingly, if circular end plates are disposed on, and sealed to, the axial facing ends of spiral elements 1 and 2, respectively, and if one of the end plates is provided with a discharge port 4 at the center thereof as shown in figures, fluid is taken into the fluid pockets at the radial outer portion and is discharged from the discharge portion 4 after compression.

Referring to FIG. 2, the compression cycle of fluid in one fluid pocket will be described. FIG. 2 shows the relationship of fluid pressure in the fluid pocket to crank angle, and shows that one compression cycle is completed in this case at a crank angle of $4\pi$.

The compression cycle begins (FIG. 1*a*) with the other end of each spiral element in contact with the opposite spiral element, the suction stroke having finished. The state of fluid pressure in the fluid pocket is shown at point K in FIG. 2. The volume of the fluid pocket is reduced and compressed by the revolution of the orbiting scroll member until the crank angle reaches 2, which state is shown by the point L in FIG. 2. Immediately after passing this state, and hence, passing point L, tne pair of fluid pockets are connected to one another and simultaneously are connected to the space filled with high pressure, which is connected to the discharge chamber and is formed at the center of both spiral elements. At this time, if the compressor is not provided with a discharge valve, the fluid pressure in the connected fluid pockets suddenly rises to equal the pressure in the discharge chamber. If, however, the compressor is provided with a discharge valve, the fluid pressure in the connected fluid pockets rises slightly due to the mixing of the high pressure fluid and the fluid in the connecting fluid pockets. This state is shown at point M in FIG. 2. The fluid in the high pressure space is further compressed by revolution of the orbiting scroll member until it reaches the discharge pressure. This state is shown at point N in FIG. 2. When the fluid pressure in the high pressure space reaches the discharge pressure, the fluid is discharged to the discharge chamber through the discharge hole by the operation of the discharge valve. Therefore, fluid pressure in the high pressure space is maintained at the discharge pressure until a crank angle of $4\pi$ (point O).

Accordingly, one cycle of compression is completed at a crank angle of $4\pi$, but the next begins at the midpoint of compression of the first cycle as shown by points K′, L′ and M′, and the dot-dash line in FIG. 2. Therefore, fluid compression proceeds continuously by the operation of these cycles.

Line contact between spiral elements is defined by several pairs of points as shown in FIG. 3. However, it is very difficult to attain complete contact at all points. If the line contact between spiral elements is imperfect at one or more points to form a gap, fluid leakage through the gap will occur during operation to allow the outer pockets to contain gas with higher pressure than the ideal case. The volumetric efficiency of the compressor and, hence, its refrigeration capacity will thereby be reduced. Fluid leakage across the line contact separating a pair of fluid pockets from the high pressure space is an especially very serious problem. If such leakage occurs, the pressure in the fluid pocket rises, as shown by the dotted lines and letters l, m, n in FIG. 2. Therefore, the torque or the power required in the compressing operation, is increased. As a result, the energy efficiency ratio (refrigeration capacity performed by a unit horse power) is greatly reduced. Thus, sealing of the high pressure space must be tightly secured.

The curve of the spiral elements is usually an involute curve of a circle, each spiral having the same pitch (the pitch shown as distance $a_1$—$a_2$, $a_2$—$a_n$, or $b_1$—$b_2$, $b_2$—$b_n$ in FIG. 3), and these two spiral elements interfit at an angular and radial offset, so that the spiral elements make a plurality of line contacts which are represented by points $a_1$—$a_n$ and $b_1$—$b_n$ in FIG. 3. Therefore, if the pitch of the spiral element is slightly different or if the inner and outer wall curve deviates from a true involute curve due to manufacturing inaccuracies, the line contacts will be imperfect, and the apparatus which uses these spiral elements will suffer fluid leakage. In order to avoid this problem, high accuracy is required in manufacturing the spiral elements, resulting in high cost.

Even when two perfect spiral elements (having no dimensional errors) are interfitted and used in a compressor, heat developed during operation creates a thermal expansion of the elements. If the temperature is uniform throughout the spiral elements, the line contacts between both spiral elements change uniformly, and sealing of the fluid pockets is maintained. However, under actual operating conditions, thermal expansion of the spiral elements is nonuniform due to the temperature gradients, material nonuniformity or other imperfections, resulting in a nonuniform pitch variation or deviation of wall curves from a true involute. This causes a gap at the line contacts between the spiral elements, resulting in fluid leakage from the high pressure space.

SUMMARY OF THE INVENTION

It is a primary object of this invention to provide an efficient scroll type fluid displacement apparatus.

It is another object of this invention to provide a scroll type fluid displacement apparatus wherein the line contact between the two spiral elements is insured in order to seal the high pressure space.

It is still another object of this invention to realize the above objects with a simple construction, a simple production method and low cost.

A scroll type fluid displacement apparatus according to this invention includes a housing and a pair of scroll members. One of the scroll members is fixedly disposed relative to the housing and has an end plate from which a first spiral wrap extends into the interior of the housing. The other scroll member is movably disposed for nonrotative orbital movement within the interior of the housing and has an end plate from which a second spiral wrap extends. The first and second wraps are interfitted at an angular and radial offset to make a plurality of line contacts to define at least one pair of sealed off fluid pockets. A driving mechanism is operatively connected to the other scroll member to effect its orbital motion, whereby the fluid pockets move inwardly and change in volume. The two innermost pockets eventually are merged into a single pocket near the center of the wraps. The center portions of the wraps are thicker than the remaining portions thereof. The center portions extend substantially from the inner ends of the wraps outwardly at least throughout the portions thereof which contact one another when the two innermost fluid pockets are merged into a single fluid pocket. Therefore, sealing of the high pressure space which is formed at the center of the wraps is maintained without being affected by dimensional errors of the wraps or by thermal expansion with help of the compliant drive mechanism.

Further objects, features and other aspects of this invention will be understood from the following detailed description of the preferred embodiments of this invention referring to the annexed drawings. The description relates to a scroll type compressor for the sake of convenience, but the invention is not limited to compressors.

BRIEF DESCRIPTION OF THE DRAWINGS

FIG. 7 is an exploded perspective view of the rotation preventing/thrust bearing mechanism used in the compressor of FIG. 4;

FIG. 8 is a schematic view illustrating the interfitting relationship of spiral elements according to one embodiment of this invention;

DETAILED DESCRIPTION OF THE PREFERRED EMBODIMENT

Figure 1A:
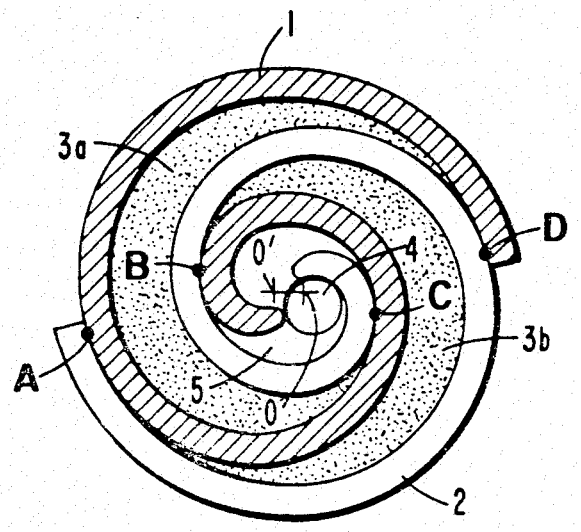
FIGS. 1*a*–1*d* are schematic views illustrating the relative movement of interfitting spiral elements to compress the fluid.
Figure 1B:
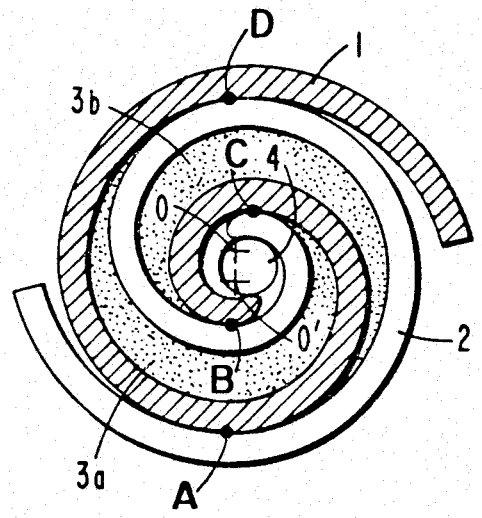
Figure 1C:
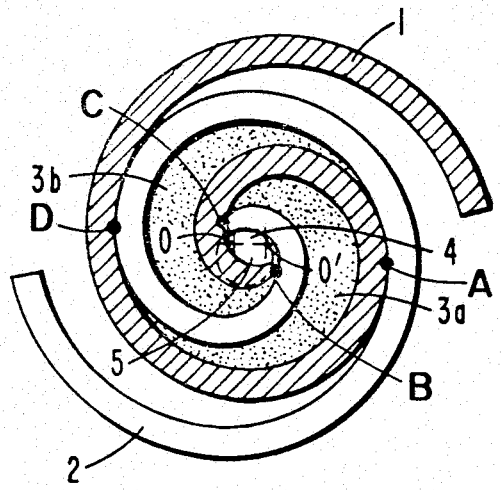
Figure 1D:
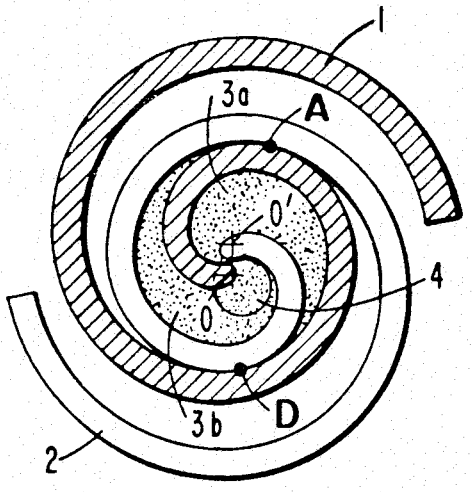
Figure 2:
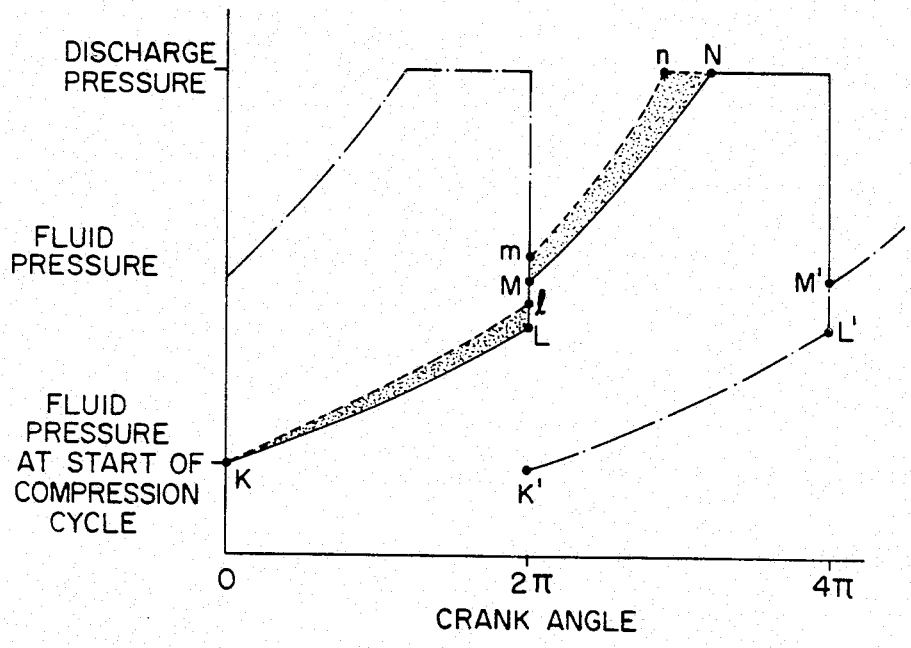
FIG. 2 is a pressure-crank angle diagram illustrating the compression cycle in each of the fluid pockets.
Figure 3:
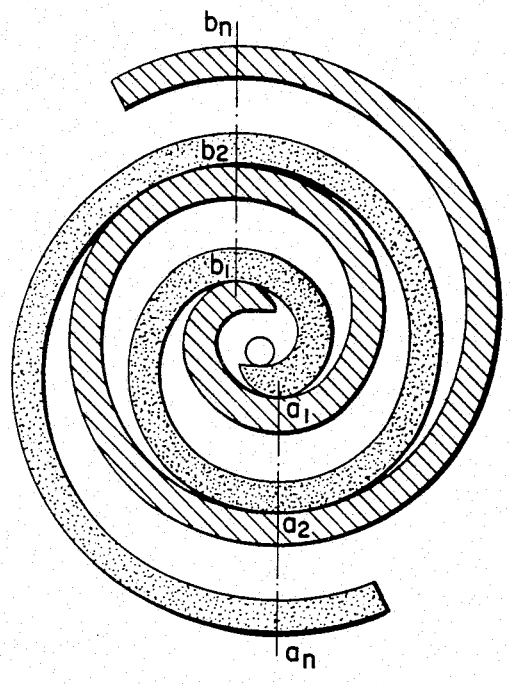
FIG. 3 is a schematic view illustrating the interfitting relationship of prior art spiral elements.
Figure 4:
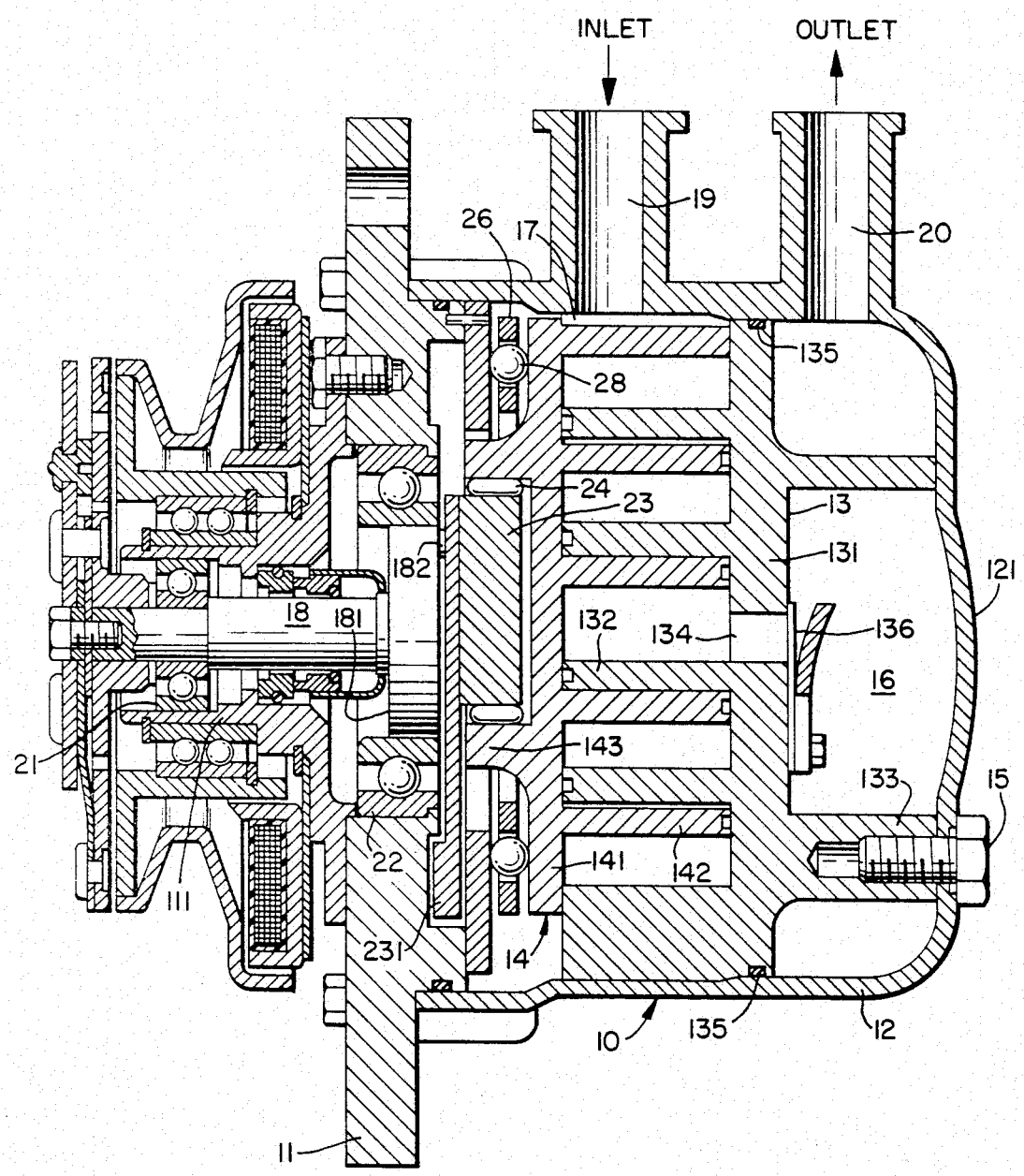
FIG. 4 is vertical sectional view of a compressor of the scroll type according to the invention.

Referring to FIG. 4, a refrigerant compressor unit according to the invention is shown which includes a compressor housing 10 comprising a front end plate 11 and a cup-shaped casing 12 disposed on the end surface of front end plate 11.

A fixed scroll member 13, an orbiting scroll member 14, a driving mechanism and a rotation prevent/thrust bearing mechanism of orbiting scroll member 14 are disposed within an inner suction chamber of cup-shaped casing 12. These mechanisms are described in detail below. The inner chamber is defined by the side wall of cup shaped casing 12, the inner end surface of front end plate 11, and fixed scroll member 13.

Fixed scroll member 13 includes a circular end plate 131 and an involute wrap or spiral element 132 affixed to and extending from one major end surface of end plate 131. End plate 131 of fixed scroll member 13 is formed with a plurality of internally threaded bosses 133 axially projecting from a major end surface of plate 131 opposite the side thereof from which spiral element 132 extends. The end of each boss 133 abuts the inner surface 121 of cup shaped casing 12, and is fixed casing 12 by screws 15 which screw into bosses 133 from the outside of casing 12. Hence, fixed scroll member 13 is fixedly disposed within cup shaped casing 12. End plate 131 of fixed scroll member 13 partitions the interior of cup shaped casing 12 into two chambers, a discharge chamber 16 and a suction chamber 17, and a sealing member 135 is disposed between the outer periphery of end plate 131 and the inner wall of cup shaped casing 12 to isolate these two chambers.

Orbiting scroll member 14 is disposed in suction chamber 17 and also comprises a circular end plate 146 and an involute wrap or spiral element 142 is affixed to and extending from one end surface of end plate 141. Spiral element 142 and spiral element 132 of fixed scroll member 13 are interfitted at an angular offset of 180° and a predetermined radial offset. A pair of fluid pockets are thereby defined between spiral elements 132, 142. Orbiting scroll member 14 is connected to the driving mechanism and the rotation preventing/thrust bearing mechanism. These mechanisms effect the orbital motion of orbiting scroll member 14 at a circular radius $R_o$ by the rotation of a drive shaft 18, to thereby compress the fluid in the fluid pockets, as above described in connection with FIGS. 1*a*–1*d*.

Thus, when orbiting scroll member 14 is allowed to undergo the orbital motion with the radius $R_o$ by rotation of drive shaft 18, fluid or refrigerant gas, introduced into suction chamber 17 from an external fluid circuit through an inlet port 19 on casing 12, is taken into the fluid pockets formed between spiral elements 132, 142. As orbiting scroll member 14 orbits, fluid in the fluid pockets is moved to the center of the spiral elements with a consequent reduction of volume thereof. Compressed fluid is discharged into discharge chamber 16 from the fluid pocket at the center of the spiral element through a hole 134 which is formed through circular plate 131 at a position near the center of spiral element 132, and a reed-type valve 136, and therefrom is discharged through an outlet port 20 to an external fluid circuit.

Figure 5:
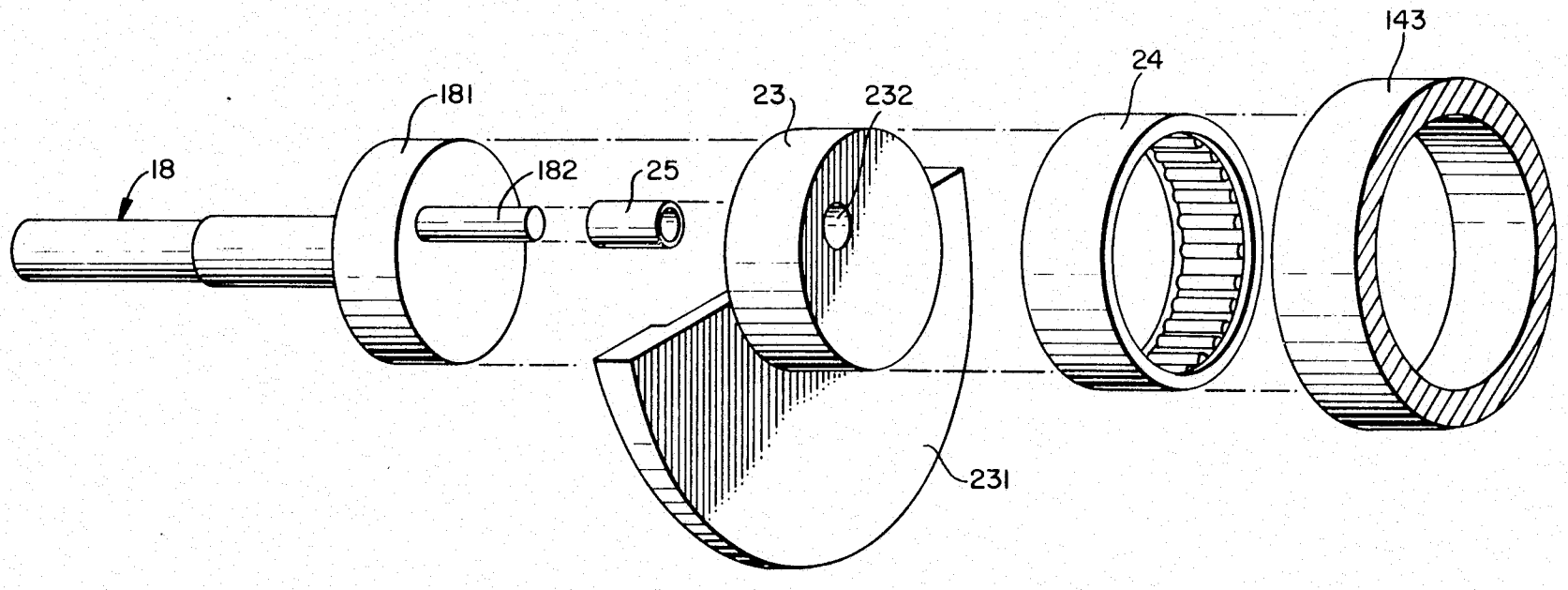
FIG. 5 is an exploded perspective view of the driving mechanism used in the compressor of FIG. 4.

Referring to FIGS. 4 and 5, the driving mechanism of orbiting scroll mechanism 14 will now be described. Drive shaft 18 is rotatably supported by a sleeve portion 111 of front end plate 11 through a bearing 21 and is formed with a disk portion 181 at its inner end portion. Disk portion 181 is also rotatably supported by front end plate 11 through a bearing 22 which is disposed within an opening of front end end plate 11.

A crank pin or drive pin 182 projects axially from an end surface of disk portion 181 and, hence, from an end of drive shaft 18, and is radially offset from the center of drive shaft 18. End plate 141 of orbiting scroll member 14 is provided with a tubular boss 143 axially projecting from the end surface opposite to the surface thereof from which spiral element 142 extends. A discoid or short axial bushing 23 is fitted into boss 143, and is rotatably supported therein by a bearing, such as a needle bearing 24. Bushing 23 has a balance weight 231 which is shaped as a portion of a disc or ring and extends radially from bushing 23 along a front surface thereof. An eccentric hole 232 is formed in bushing 23 radially offset from the center of bushing 23. Drive pin 182 is fitted into the eccentrically disposed hole 232 within which bearing 25 may be applied. Bushing 23 is therefore driven by the revolution of drive pin 182 and permitted to rotate by needle bearing 24.

Figure 6:
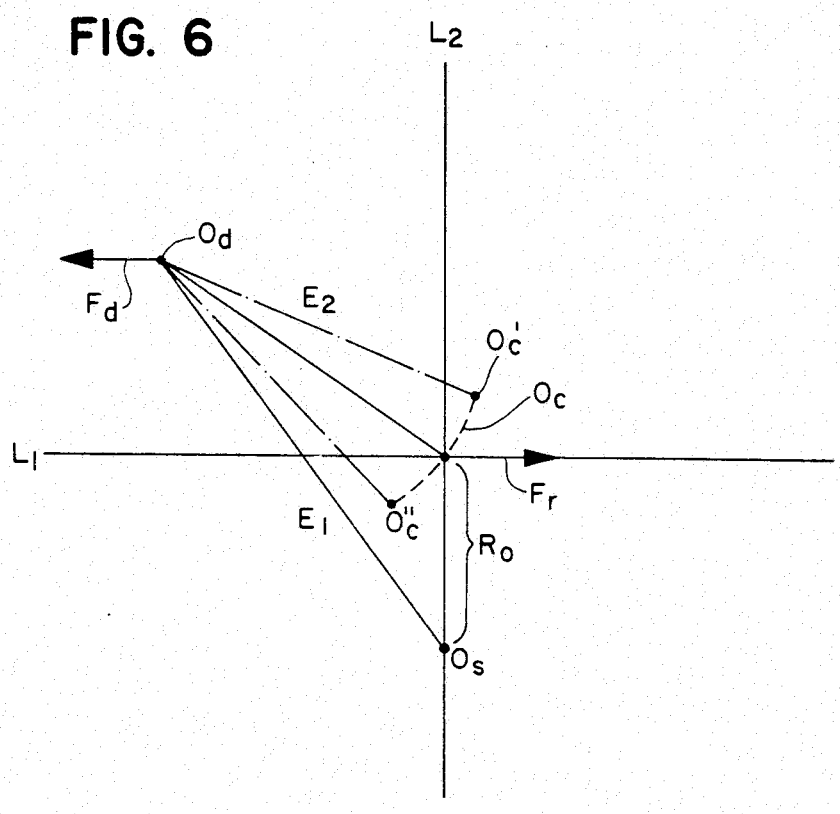
FIG. 6 is an explanatory diagram of the motion of the eccentric bushing illustrated in FIG. 4.

Respective location of center $O_s$ of drive shaft 18, center $O_c$ of bushing 23, and center $O_d$ of hole 232 and thus drive pin 182 is shown in FIG. 6. In the position shown in FIG. 6, the distance between $O_s$ and $O_c$ is the representative radius $R_o$ of orbital motion of theorbiting scroll member, and when drive pin 182 is placed in eccentric hole 232, center $O_d$ of drive pin 182 is placed, with respect to $O_s$, on the opposite side of a line $L_1$, which is through $O_c$ and perpendicular to a line $L_2$ through $O_c$ and $O_s$, and also beyond the line through $O_c$ and $O_s$ in direction of rotation A of drive shaft 18.

In this construction of the driving mechanism, center $O_c$ of bushing 23 is permitted to swing about the center $O_d$ of drive pin 182 at a radius $E_2$. As shown in FIG. 6, such swing motion of center $O_c$ is illustrated as arc $O_c'$—$O_c''$ in FIG. 6. This permitted swing motion allows the orbiting scroll member 14 to compensate its motion for changes in radius $R_o$ due to wear on the spiral elements or due to dimensional inaccuracies of the spiral elements. When drive shaft 18 rotates, a drive force $F_d$ is applied to the left at center $O_d$ of drive pin 182 and a reaction force $F_r$ of gas compression appears to the right at center $O_c$ of bushing 33, both forces being parallel to line $L_1$. Therefore, the arm $O_d$—$O_c$ can swing outwardly by creation of the movement generated by the two forces. Spiral element 142 of orbiting scroll member 14 is thereby forced toward spiral element 132 of fixed scroll member 13 to make at least one point of contact among several pairs of sealing points which will be explained later and the center of orbiting scroll member 14 orbits with the representative radius $R_o$ around center $O_s$ of drive shaft 18. The rotation of orbiting scroll member 14 is prevented by the rotation preventing/thrust bearing mechanism 26 (FIG. 7), whereby orbiting scroll member 14 orbits while maintaining its angular orientation related to fixed scroll member 13.

Referring to FIGS. 7 and 4, a rotation preventing/thrust bearing mechanism 26 surrounds boss 143 and comprises a fixed ring 261 and and Oldham ring 262. Fixed ring 261 is secured to an inner surface of housing 10. Fixed ring 261 is provided with a pair of keyways 261*a*, 261*b* in an axial end surface facing orbiting scroll member 14. Oldham ring 262 is disposed in a hollow space between fixed ring 261 and end plate 141 of orbiting scroll member 14. Oldham ring 262 is provided with a pair of keys 262*a*, 262*b* on the surface facing fixed ring 261, which are received in keyways 261*a*, 261*b*. Therefore, Oldham ring 262 is linearly slidable relative to fixed ring 261 by the guide of keys 262*a*, 262*b* within keyways 261*a*, 261*b*. Oldham ring 262 is also provided with a pair of keys 262*c*, 262*d* on its opposite surface. Keys 262*c*, 262*d* are arranged along a diameter perpendicular to the diameter along which keys 262*a*, 262*b* are arranged. Circular end plate 141 of orbiting scroll member 14 is provided with a pair of keyways (in FIG. 7 only one keyway 141*a* is shown; the other keyway is disposed diametrically opposite keyway 141*a*) on the surface facing Oldham ring 262 in which are received keys 262*c*, 262*d*. Therefore, orbiting scroll member 14 is linearly slidable relative to Oldham ring 262 by the guide of keys 262*d*, 262*d* within the keyways of end plate 141.

Accordingly, orbiting scroll member 14 is slidable in one radial direction with Oldham ring 262, and is independently slidable in another radial direction perpendicular to the first radial direction. Therefore, rotation of orbiting scroll member 14 is prevented, while its movement in two radial directions perpendicular to one another is permitted. Now, Oldham ring 262 is provided with a plurality of holes or pockets 27, and a bearing means, such as ball 28 having a diameter which is greater than the thickness of Oldham ring 262, is retained in each pocket 27. Balls 28 contact and roll on the surface of fixed ring 261 and circular end plate 141 of orbiting scroll member 14. Therefore, the thrust load from orbiting scroll member 14 is supported on fixed ring 261 through balls 28.

As explained below, the radius $R_o$ of orbital motion is determined by one contact point between the spiral elements having the minimum of the angle $\angle O_cO_dO_s$. Bushing 23 is supported to permit swing motion about drive pin 182, and this swing motion allows the orbiting scroll member 14 to compensate its motion for variation of radius $R_o$. On the other hand, spiral element 142 of orbiting scroll member 14 is forced toward spiral element 132 of fixed scroll member 13 by the driving moment. The radius $R_o$ is determined by the combination of the errors of the spiral elements, for example, by either a combination of the maximum inward deviation of the inner wall of the fixed spiral element and the maximum outward deviation of the outer wall of the orbiting spiral element, or a combination of the maximum outward deviation of the outer wall of the fixed spiral element and the maximum inward deviation of the inner wall of the orbiting spiral element, from the theoretical involute curve for each wall. There are various manners in which the actual orbiting radius varies as the crank angle proceeds, but the first portion to contact the opposite wall of the other spiral element, determines the radius $R_o$ as a function of the crank angle, in other words the orbiting scroll member 14 orbits with radius $R_o$ which is determined by the first contact point between spiral elements 132, 142, and the actual contact point to determine the radius can be near the outer end of the wrap to form gaps between the two spiral walls in the area of the high pressure space.

FIG. 8 shows the configuration of spiral elements according to one embodiment of the present invention. As shown in FIG. 8, the wall of the center portion of each spiral element is made slightly thicker (by $\alpha$ in FIG. 8) by making a slight step along the inner wall thereof. The thicker portion of each spiral element extends from the inner end portion or tip of the spiral element (shown at point A in FIG. 8) to a location along the spiral which is spaced from the tip by an involute angle of at least $2\pi$ (shown at point B in FIG. 8). The outer portion of each spiral element extends from point B to the outermost end of the spiral element (shown at point D in FIG. 8) with a reduced thickness. When the two spiral elements are interfitted at an angular and radial offset for the involute portions from A to B of both spiral elements to make line contact, a small gap may arise at the point where the line contacts should be between the spiral elements in the involute range from B to D. However, the more important seal of the high pressure space which is defined in the center of both spiral elements is insured by the thicker portions from A to B (hereinafter designation A-B will be used) of the inner wall of the spiral elements. The same effect may alternatively be achieved by a step on the outer (rather than the inner) wall thereof at points corresponding to B for each spiral.

In accordance with the above construction of spiral elements, when the thickness of portion B-D has a dimensional error ($\Delta E$) of less than the step ($\alpha$) between portion A-B and portion B-D, the sealing of the high pressure space will not be disturbed. The fluid leakage across the gap at the line contacts between the outer portions (B-D) of the spirals is considered to be minimal, because the pressure difference between outer fluid pockets is small. Deterioration of volumetric efficiency of the compressor due to this minimal leakage is thereby permissible.

Figure 9:
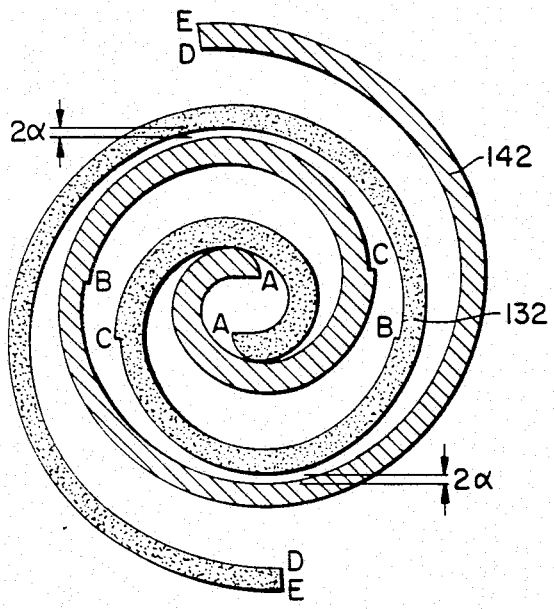
FIG. 9 is a schematic view similar to FIG. 8 illustrating a modified interfitting relationship of spiral elements according to the invention.

FIG. 9 shows a modification of the embodiment shown in FIG. 8, wherein the center portion of each spiral element is made thicker by a slight step ($\alpha$) on the inner and outer walls thereof. This thicker portion extends from the inner portion or tip of each spiral element 132, 142 (shown at point A in FIG. 9) at least throughout the portions of the spiral elements which contact one another when the pair of fluid pockets are connected to the high pressure space (shown at points B and C in FIG. 9). The slightly thinner outer portion extends from the points B or C to the terminal ends of both spiral elements 132, 142 (shown at points D and E in FIG. 9). Therefore, when these two spiral elements are interfitted with one another, a gap (shown as $2\alpha$ in FIG. 9) between the portion B-D and the portion C-E of both spiral elements results. However, the important seal of the high pressure space which is defined at the center of the spiral elements is insured.

Figure 10:
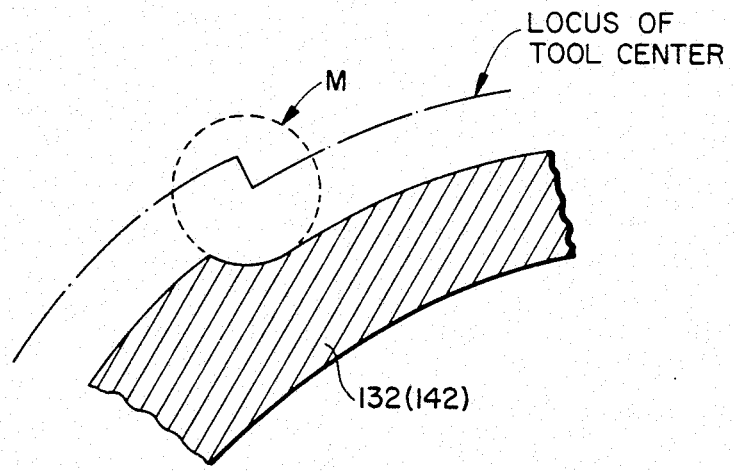
FIG. 10 is a schematic view illustrating the configuration of the transition portion of a spiral element.

The transition between the thicker portion and the thinner portion of each spiral is shown in FIGS. 8 and 9 to be steplike. However, the transition can be arcuate, rather than stepped, as shown in FIG. 10. The radius of curvature of the arcuate transition portion is determined by the radius of the milling tool M used to form the spiral element. The arcuate transition portion is formed when the milling tool reaches the end of its travel after forming an adjacent portion of spiral.

Figure 11A:
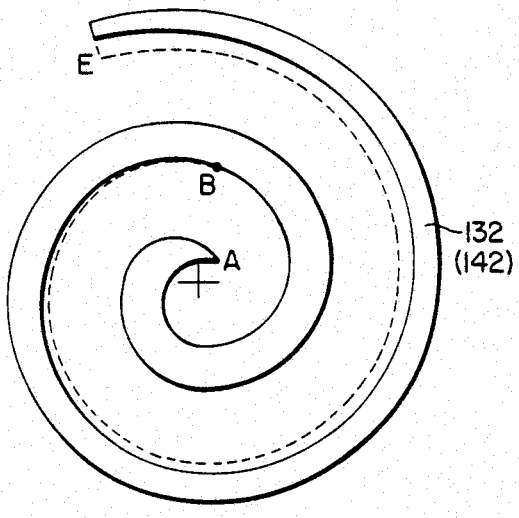
FIGS. 11*a*–11*c* are schematic views illustrating the configuration of spiral elements according to a third embodiment of this invention.

FIG. 11*a* shows another embodiment of the present invention, which is characterized in that the inner wall of the outer portion of the spiral element starts deviating from a true involute curve at point B to form a portion of gradually reduced thickness. The wall thickness of the inner portion, which is between the inner end portion or tip of each spiral element (point A) and point B, is uniform. Since the wall thickness between point B and the outer terminal end (point D) gradually reduces, the gap ($\alpha$) between the spiral elements will be a function of the involute angle.

Figure 11B:
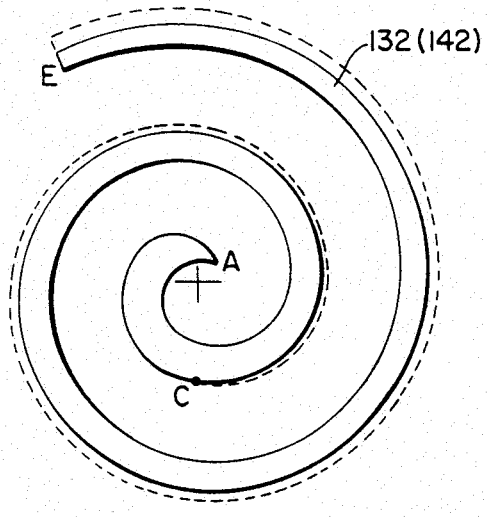
Figure 11C:
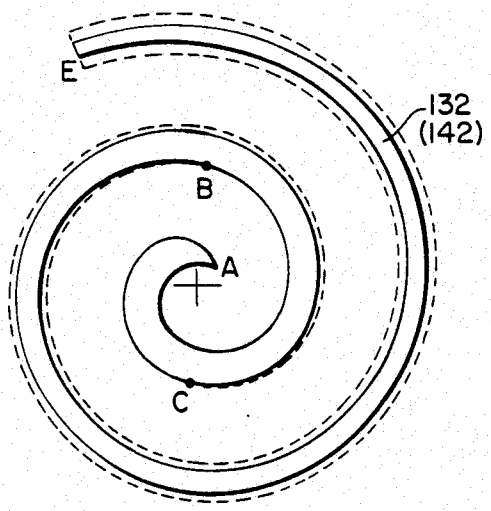

FIGS. 11*b* and 11*c* show modifications of the embodiment shown in FIG. 11*a*, wherein the center portion of each spiral element is formed to a true involute curve and the outer wall of the outer portion of the spiral element starts deviating from a true involute curve at point C to form a portion of gradually reduced thickness (shown in FIG. 11*b*), or the inner and outer wall of the outer portion of the spiral elements start deviating from a true involute curve at points B and C to form a portion of gradually reduced thickness (shown in FIG. 11*c*).

This invention has been described in detail in connection with preferred embodiments, but these embodiments are merely for example only and this invention is not restricted thereto. It will be easily understood by those skilled in the art that other variations and modifications can be easily made within the scope of the invention, as defined by the appended claims.

We claim:

1. In a scroll type fluid displacement apparatus including a housing, a pair of scroll members, one of said scroll members fixedly disposed relative to said housing and having an end plate from which a first spiral wrap means extends into the interior of said housing and the other scroll member movably disposed for non-rotative orbital movement within the interior of said housing and having an end plate from which a second spiral wrap means extends, said first and second wrap means interfitting at an angular and radial offset to make a plurality of line contacts to define at least one pair of sealed off fluid pockets, and drive means operatively connected to said other scroll member to effect the orbital motion of said other scroll member and said line contacts whereby said fluid pockets move inwardly and change in volume, the two innermost fluid pockets eventually merging into a single pocket near the center of said wrap means, the improvement wherein the entire center portion of each of said wrap means is thicker than the remaining portion thereof, said center portions extending substantially from the inner ends of said wrap means outwardly to the portions thereof which contact one another when said two innermost fluid pockets are merged into a single fluid pocket.

2. The improvement as claimed in claim 1, wherein said thicker center portion of each wrap means is formed with a step on the inner wall of said center portion.

3. The improvement as claimed in claim 1, wherein said thicker center portion of each wrap means is formed with a step on the outer wall of said center portion.

4. The improvement as claimed in claim 1, wherein said thicker center portion of each wrap means is formed with a step on both the inner and outer walls of said center portion.

5. The improvement as claimed in claim 1, 2, 3 or 4, wherein a transition portion is formed on each of said wrap means between said thicker center portion and the thinner outer portion thereof.

6. The improvement as claimed in claim 5, wherein said transition portion is stepped.

7. The improvement as claimed in claim 5, wherein said transition portion is arcuate.

8. The improvement as claimed in claim 1, 2, 3 or 4, wherein the thickness of the thinner outer portion of each of said wrap means gradually diminishes toward the outer terminal end thereof.

9. A scroll type fluid compressor unit comprising:

a housing having a fluid inlet port and a fluid outlet port;

a fixed scroll member fixedly disposed relative said housing and having an end plate from which a first spiral wrap means extends into the interior of said housing;

an orbiting scroll member movably disposed within said housing and having an end plate from which a second spiral wrap means extends, said first and second wrap means interfitting at an angular and radial offset to make a plurality of line contacts to define at least one pair of sealed off fluid pockets;

rotation preventing means for restraining said orbiting scroll member to orbital motion;

a driveshaft rotatably supported by said housing; and drive means operatively coupling said driveshaft to said orbiting scroll member to effect orbital motion of said orbiting scroll member by rotation of said driveshaft and effect said line contacts, whereby said fluid pockets move inwardly and change volume, the two innermost fluid pockets eventually merging into a single pocket near the center of said wrap means, the entire center portion of each of said wrap means being thicker than the remaining portion thereof, said center portions extending substantially from the inner ends of said wrap means outwardly to the portions thereof which contact one another when said two innermost fluid pockets are merged into a single fluid pocket.

10. The improvement as claimed in claim 9, wherein said thicker center portion of each wrap means is formed with a step on the inner wall of said center portion.

11. The improvement as claimed in claim 9, wherein said thicker center portion of each wrap means is formed with a step on the outer wall of said center portion.

12. The improvement as claimed in claim 9, wherein said thicker center portion of each wrap means is formed with a step on both the inner and outer walls of said center portion.

13. The improvement as claimed in claim 9, 10, 11 or 12, wherein a stepped transition portion is formed on each of said wrap means between said thicker center portion and the thinner outer portion thereof.

14. The improvement as claimed in claim 9, 10, 11 or 12, wherein an arcuate transition portion is formed on each of said wrap means between said thicker center portion and the thinner outer portion thereof.

15. The improvement as claimed in claim 9, 10, 11 or 12, wherein the thickness of the thinner outer portion of each of said wrap means gradually diminishes toward the outer terminal end thereof.

* * * * *